United States Patent [19]

Boit et al.

[11] Patent Number: 4,680,461

[45] Date of Patent: Jul. 14, 1987

[54] PICTURE INTENSIFIER TUBE WITH MEMORIZATION

[75] Inventors: Jean C. Boit; Jean P. Galves, both of Paris, France

[73] Assignee: Thomson-CSF, Paris, France

[21] Appl. No.: 775,947

[22] Filed: Sep. 12, 1985

Related U.S. Application Data

[63] Continuation of Ser. No. 419,572, Sep. 17, 1982, abandoned.

[30] Foreign Application Priority Data

Sep. 22, 1981 [FR] France ..... 81 17848

[51] Int. Cl.[4] ..... H01J 31/50

[52] U.S. Cl. ..... 250/213 VT; 313/525; 365/111

[58] Field of Search ..... 250/213 R, 213 VT, 207; 313/525, 529, 543, 463; 340/781; 365/106, 111, 110

[56] References Cited

U.S. PATENT DOCUMENTS

| | | | |
|---|---|---|---|
| 3,590,253 | 6/1971 | Novice et al. | 250/213 R |
| 3,710,081 | 1/1973 | Tanaka et al. | 313/525 X |
| 3,967,112 | 6/1976 | Kanatani et al. | 250/213 R |
| 3,971,931 | 7/1976 | Jehle | 250/213 R |
| 4,155,030 | 5/1979 | Chang | 313/463 X |
| 4,184,069 | 1/1980 | Bosserman | 250/213 VT |
| 4,206,460 | 6/1980 | Yasuda et al. | 340/781 |
| 4,207,617 | 6/1980 | Yasuda et al. | 365/106 |
| 4,221,002 | 9/1980 | Alt et al. | 365/110 |
| 4,249,133 | 2/1981 | Barta | 313/463 X |
| 4,371,806 | 2/1983 | Bintig et al. | 250/213 VT |

FOREIGN PATENT DOCUMENTS

| | | |
|---|---|---|
| 0000613 | 2/1979 | European Pat. Off. . |
| 2195841 | 3/1974 | France . |
| 2050777 | 1/1981 | United Kingdom . |

OTHER PUBLICATIONS

Applied Physics Letters, vol. 31, No. 6, Sep. 15, 1977, New York, US.

W. E. Howard & P. M. Alt: "Electron-beam switching of thin-film ZnS electroluminescent devices", pp. 399-401.

*Primary Examiner*—Edward P. Westin

*Attorney, Agent, or Firm*—Roland Plottel

[57] ABSTRACT

An apparatus and method for obtaining a memory function in picture intensifier or amplifier tubes by providing such tubes with an output screen formed of an electroluminescent cell. This cell emits visible light rays when an electric voltage is applied between its surfaces, and possesses hysteresis properties. When voltage is applied to the screen, the picture sent by the electron beam is stored, and re-established when desired, for a given period. The invention can be applied to radiology.

2 Claims, 8 Drawing Figures

PICTURE INTENSIFIER TUBE WITH MEMORIZATION

This application is a continuation of Ser. No. 419,572, filed Sept. 17, 1982, now abandoned.

BACKGROUND OF THE INVENTION (1) Field of the Invention

The invention concerns a picture intensifier or amplifier tube and its use.

Such a tube produces a high-brilliancy light picture, which is formed on the tube output screen when the input screen is exposed to incident rays. Between these two screens a flow of electrons, emitted by a photocathode incorporated in the input screen, transfers the signal at each point from one end of the tube to the other.

(2) Description of the Prior Art

Such tubes are well known in the prior art, being used with incident X-rays, particularly for medical purposes.

In this case, they also act as converters, transforming incident X-rays into visible rays.

The output screen is generally an ordinary cathodoluminescent screen, which can emit light when bombarded by an electron flow. Consequently, it can work only in real-time, with the picture visible on the output screen only at the same moment as it is produced on the input screen. Traces may persist on the output screen, for periods that vary depending upon the arrangements adopted, but they are relatively short at the present stage of technical development of such screens.

Another type of screen exists, thin-layer electroluminescent screens, which can emit visible rays when excited by an electrical voltage applied between their two faces. This occurs above a characteristic threshold voltage, and for some of these screens the emission even persists for a certain time after the voltage has been reduced below this threshold. The drop in luminance then occurs with hysteresis, naturally causing memorization. A voltage can then memorize, display and erase a signal, as is usual with hysteresis phenomena.

This type of screen, like cathodoluminescent screens, is sensitive to electron bombardment, but it is used for a different purpose: the electron bombardment here adds its own action to the action of the applied voltage; it adds further voltage to the voltage applied to the input. Specifically, it makes it possible for the combined voltages to rise above the threshold voltage even when an input voltage less than this threshold is supplied to the screen. Generally, electron bombardment makes it possible to process the signal in various ways described in fuller detail below.

In the prior art, the usefulness of employing electroluminescent output screens has already been recognized in many types of electronic tubes, to obtain extended persistence of images, and thereby to memorize such pictures. Several devices with tubes equipped with such screens have been proposed, e.g., French Pat. No. 2,431,184, and U.S. Pat. No. 3,908,148.

However, all these developments concern cathode-ray tubes (CRT), tubes in which an electron beam scans the display screen to form a picture on it sequentially, point by point.

Such electroluminescent screens would be even more useful in tubes where the image on the output screen is formed by an electron flow which impacts the whole screen surface simultaneously, so that at any given moment, the screen is wholly "sprayed" by the electron beam. This spraying may be either constant during filming or may consist of pulses.

This is typically the case for radiological picture intensifiers (RPI), i.e., amplifiers used for medical purposes and light picture intensifiers (LPI), i.e., amplifiers used to obtain pictures under poor nocturnal lighting conditions.

SUMMARY OF THE INVENTION

This invention concerns tubes of the RPI or LPI types combining an electroluminescent output screen with the other components of such tubes, thereby obtaining a number of advantages not normally available in the prior art. More generally, the invention relates to tubes in which electron flow carrying the signal from the tube input simultaneously impacts the output screen at all points.

The invention relates to a picture intensifier or amplifier tube which has an input screen exposed to incident rays and an output screen, and which guides the flow of electrons emitted by a photo-cathode incorporated in the input screen towards the output screen in order to form the image of the incident rays on the output screen. This tube has an output screen made up of an electroluminescent cell, which is able to emit visible light rays when an alternating voltage with an amplitude greater than a characteristic threshold $V_s$ is applied between its surfaces, and which possesses the property of hysteresis; once activated, the light goes out only when the voltage amplitude maintained across it drops below an erasure voltage $V_{ef}$, which is less than $V_s$. When such an output screen is bombarded by electrons, it emits visible light where subjected to such bombardment even for a maintenance voltage $V_e$, which is less than $V_s$.

BRIEF DESCRIPTION OF THE DRAWINGS

The invention will be better understood from the following description with reference to the accompanying drawings in which.

DESCRIPTION OF THE PREFERRED EMBODIMENTS

The electroluminescent output screen construction, formed of several layers as well as a certain number of its properties, will now be described.

Figure 1:
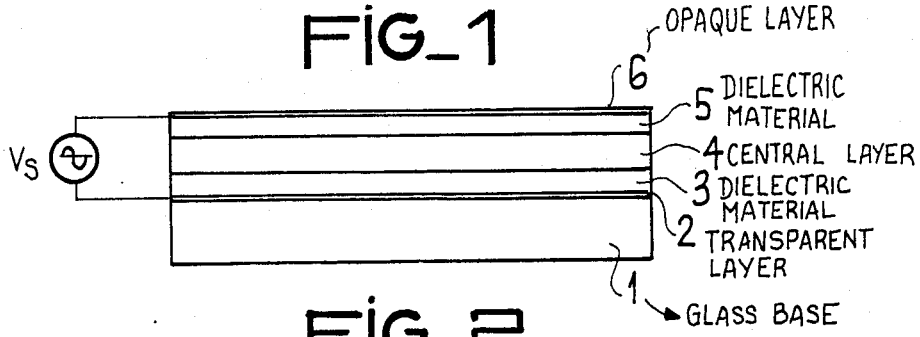
FIG. 1, is a schematical cross-section view of an electroluminescent screen; of the kind which is useful as the output screen in an image intensifier tube in accordance with the invention.

FIG. 1 is a cross-sectional view of one example of such an electroluminescent screen structure.

The central layer 4, made of manganese-doped zinc sulphide, is placed between two other layers 3 and 5, made of a dielectric material such as aluminum oxide, tantalum oxide, or silicon nitride, etc. The three layers each have approximately the same thickness (several thousand angstroms), and are held between two conducting layers 2 and 6. The lower layer 2 is made of an oxide of indium and tin, and is transparent to light rays emitted by the cell, while layer 6, made of aluminum, is opaque to such rays, to prevent any disturbance of the photo-cathode. Inside the tube, the assembly is oriented so that layer 6 faces the electron bombardment. When the tube is in operation, there is applied a potential difference between layers 2 and 6. As illustrated, this potential difference is usually alternating, of any shape (sinusoidal, with pulses of various shapes, rectangular, triangular, etc.), and of various width and frequency. The assembly of layers 2–6 with layer 2 on the bottom rests on a thick glass base 1, the thickness of which is not drawn to scale in FIG. 1.

When such a screen is excited by the applied alternating voltage of sufficient amplitude, it emits light rays in the visible spectrum. Such rays start to be emitted only when the voltage reaches a characteristic threshold voltage $V_s$, and increase rapidly in intensity when the applied voltage goes beyond this level. For example, a typical value for $V_s$ is approximately 150 volts, and the applied voltage at the point of use, corresponding to voltage Vu, typically is no more than 180 volts ($Vu-V_s$ being approximately 30 volts) under normal operating conditions corresponding to the top point of the curve in FIG. 2. The frequency of this applied voltage may vary considerably; it may be for example 5 kHz. All these values are given only to illustrate the invention and in practice actually depend upon the exact composition of the screen, and in particular on the composition of layer 4.

For certain such compositions, and more specifically for certain manganese contents, which make up between 1 and 5% of the total weight, this type of screen can memorize, as a result of the hysteresis phenomena occurring therein (cf. Howard, *Appl. Phys. Letters* vol. 31, p. 399, Sept. 1977).

Figure 2:
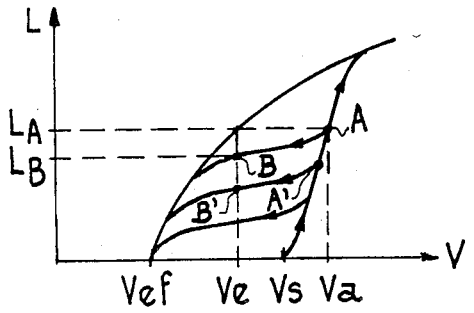
FIG. 2, is a diagram of the hysteresis cycle of an electroluminescent screen used in image intensifier tubes in accordance with the invention.

FIG. 2, which shows luminance L as a function of voltage $V(L=f(V))$, presents an example of one of these hysteresis cycles, in which of the voltages shown the threshold Voltage $V_s$, has already been defined and in which three other voltages $V_{ef}$, $V_e$ and $V_a$, will be explained below.

The screen or electroluminescent cell is excited by the positive and negative pulses of a voltage having the amplitude $V_e$, and referred to as the "maintenance voltage." The cell is not illuminated since $V_e$ is less than the threshold voltage.

The cell is then excited by an addressing voltage $V_a$ (still positive and negative pulses). The working point is A, and the cell luminance is LA.

$V_e$ pulses are again applied and the addressing voltage stopped. The working point is now B, and luminance is LB. Because of hysteresis, the cell continues to emit light even though no light was emitted before and though the voltage was the same ($V_e$ below $V_s$).

Pulse amplitude is reduced to the erasure voltage $V_{ef}$. The cell is switched off, and does not emit light.

Pulse amplitude is brought back to $V_e$ (the maintenance voltage). The cell does not emit light.

As has been already said, another property which can be provided in such screens is to respond to electron bombardment excitation, and also to ultraviolet rays. When a voltage is applied to them as described above, the additional effect of the electron bombardment makes it possible to produce a shift on the hysteresis diagram. This electron supply is equivalent to an additional voltage $\Delta V$ applied to the screen, thereby providing means of addressing a signal on the screen. This, according to the invention, is what happens in the intensifier tubes which include an electroluminescent output screen. In this case, the additional voltage $\Delta V$ is provided by an electron bombardment emitted from a photocathode incorporated in the input screen.

Figure 3:
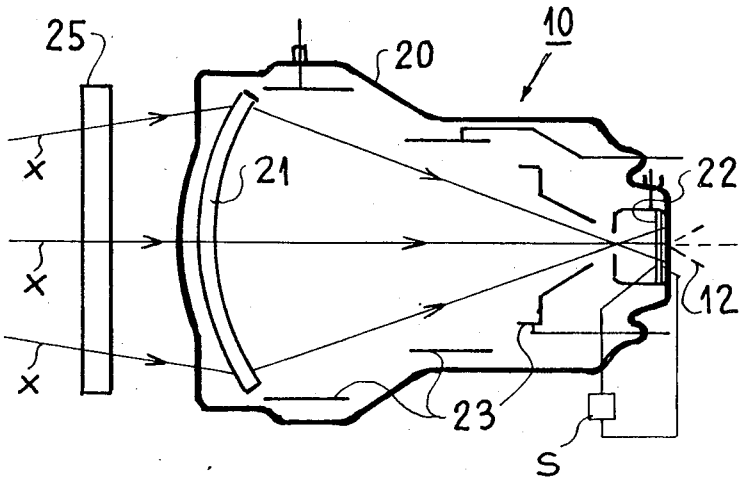
FIG. 3, is a cross section view of the basic elements of an image intensifier tube which is modified by the inclusion of an output screen of the kind shown in FIG. 1.

FIG. 3 shows the well-known basic structure of an intensifier or amplifier tube 10 which is modified by the inclusion of an output screen of the kind shown in FIG. 1.

A vacuum enclosure 20 contains an input screen 21 on its left-hand end, and an output screen 22 at the other end. Arrows indicate the electrons converging on this screen (22) emitted by the photocathode incorporated in the input screen 21, where it is placed opposite, and possibly in contact with, another part of the screen, the scintillator, which converts the incident rays, in this case X-rays, into photons for the photocathode. A series of electrodes 23, each shown with its passage (not referenced on FIG. 3), accelerates and concentrates the electrons in the direction of the output screen, which is smaller than the input screen. As is often the case in such devices, and as illustrated in FIG. 3, the output screen is at the bottom of an equipotential box (not referenced), the front face of which contains a small hole where the electron beam converges. The incident rays, indicated by the left-hand arrows, fall on the object 25, and image of which is to be obtained. The figure does not show the various power supplies for the case where the tube works following well-known conditions, but it shows that voltage is supplied to the electroluminescent output screen by a power supply S.

Figure 4:
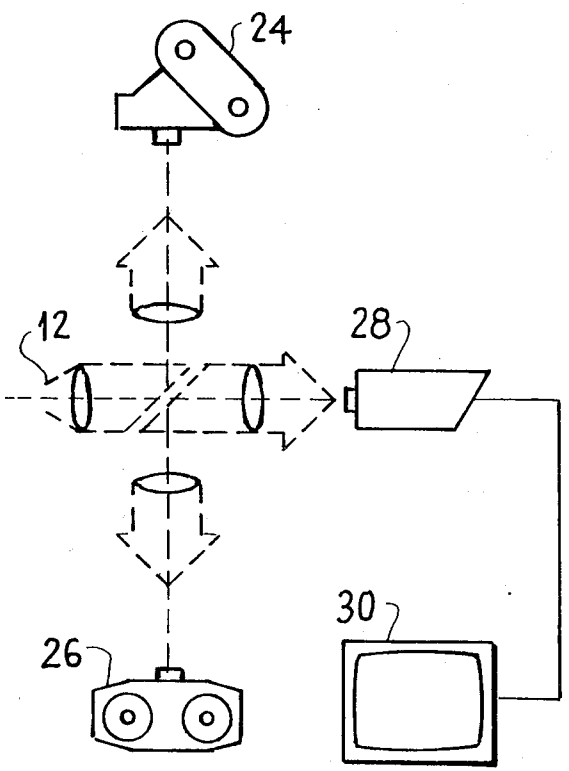
FIG. 4, is a diagram of possible applications of the tube.

FIG. 4 illustrates some of the possible uses of an intensifier tube as shown in FIG. 3.

On leaving the output screen 22, the light beam 12 is picked up by a film camera 26, or by a camera 24 for individual X-ray photographs. or by a television camera 28 for real-time display on a video-monitor screen 30. Picture intensifiers commonly provide a magnification of 150,000, i.e., 150,000 light photons emitted by the output screen for each X-photon striking the screen.

Finally, as regards the properties of screens according to this invention, the voltage increase $\Delta V$, resulting from bombardment of the electroluminescent screen by the electron beams, depends upon the duration of such bombardments and the density of the bombarding electrons.

Density is spatially modulated by the object to be reproduced, because the intensity of X-rays passing through the object depends upon the point traversed.

These are some of the uses according to this invention of tubes with electroluminescent output screens.

Bombardment by the electron beam induces internal polarization at every point on the electroluminescent cell, the field of which is added to the field set up by the AC voltage supplied to the cell; this is equivalent to a voltage increase $\Delta V$ supplied by the cell.

Effects are different, depending upon the embodiment of the invention; some examples of such embodiments are described below.

In one embodiment, the device operates with pulses, which apply X-rays to the object.

Figure 5:
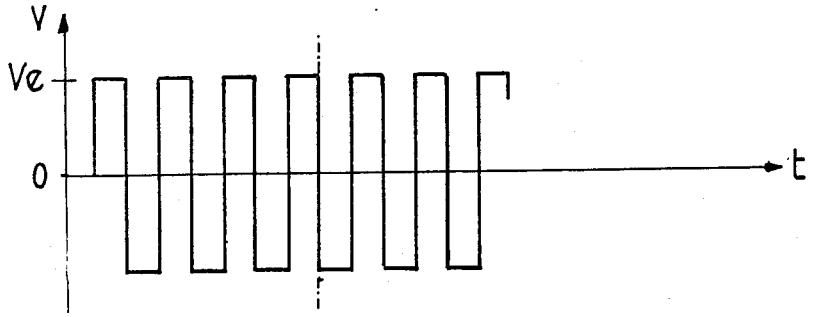
FIGS. 5 to 8, are diagrams of voltages for various embodiments of an image intensifier tube according to the invention.

Throughout the duration of the X-pulse, which may range from a few milliseconds to 1 second, for example, the spatially modulated beam addresses the cell, as explained above; the cell receives the video-signal at its various points. This information is perceived only if the voltage supplied to the cell is sufficient to be greater than the threshold voltage $V_s$, when superimposed on the *addressing* maintenance signal. This is obtained with a voltage V, an *alternate* function of time t with the form shown in FIG. 5, without any level for V=0, the maxima on each side of O being approximately the same as the maintenance voltage $V_e$ somewhere between $V_{ef}$ and $V_s$. This is also possible if a direct voltage V equal to $V_e$ is supplied; the difference between the two cases is that in the first case the image is visible during maintenance *addressing* and in the second it is not.

The information can then be used in real time throughout the addressing time (part on the left of the broken line on the figure); immediately after the X-ray pulse it can be prolonged as long as is desired, by keeping the maintenance voltage $V_e$ between the cell surfaces (part on right of line). It can also be stopped for as long as required, and re-established; during stoppage the message is stored, i.e., memorized.

Figure 6:
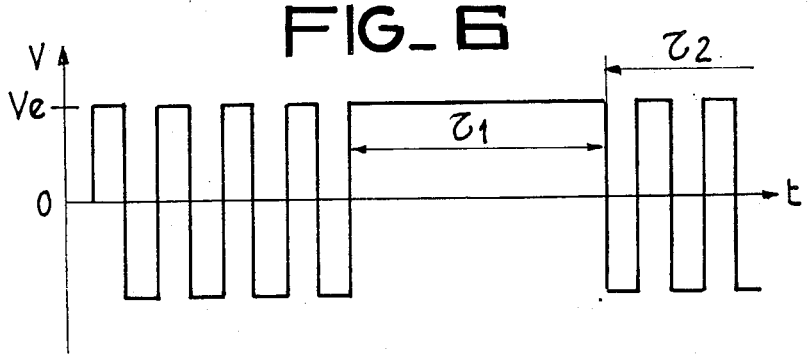

FIG. 6 shows the diagram for the voltage in this case. The interruption can be effected, as shown in the figure, by assigning to the voltage a level that does not vary in time, but is sufficient to prevent erasure (i.e., above $V_{ef}$ ). This voltage is preferably the maintenance voltage $V_e$ defined above. Throughout the duration $\tau$, corresponding to the wide level in the center of the figure, the cell under direct voltage gives no image. The image remains memorized, though not visible, and reappears at the end of this duration when the alternating voltage $V_e$ is again supplied to the cell. The image persists throughout the period $\tau_2$. It is therefore possible to store the image for a given selected time, after addressing, and prior to further reading. The operation can be repeated several times, several successive readings of the same image being possible, separated by intervals of time during which it is only memorized.

This is the first advantage of the invention over the systems in the prior art. There are, however, a number of other advantages to be noted.

Because of the form of the curves that usually make up a hysteresis diagram, as illustrated in FIG. 2 for an electroluminescent cell, the gain in such tubes according to the invention has a particular value at each point of the picture, in contrast to what happens in tubes of the same type in the prior art, where gain is the same at all points, except for screen flaws. It will be different at a point on the screen corresponding to states A and B and at a point corresponding to states A′ and B′, shown on FIG. 2. As described above, such states depend upon the electron density of the beam striking these points. Gain dynamics at the surface of the image will be quite different from what they were in the prior art, as may be seen from the curves with downward arrows in FIG. 2; these themselves depend upon the slope of the right-hand curve (upward arrows), characteristic of the chosen cell. In other words, high luminances can be obtained by selecting working points with $V_e$ near the threshold voltage $V_s$, while strong contrasts can be obtained by selecting $V_e$ close to the erasure voltage $V_{ef}$.

Another major advantage of the invention is that photo gain, the ratio of the number of light photons emitted by a given point on the cell to the number of X-ray photons striking the corresponding point on the input screen, can reach very high levels, much greater than the level mentioned, because of the possibility of storage and of successive irradiations over a very long total time. This is particularly uesful for the production of X-ray photons (24 in FIG. 4). Alternatively, the irradiation doses can be reduced for a given gain.

All other things being equal, gain depends upon the frequency of the supplied AC voltage: it is multiplied approximately 100 times when the frequency rises from 50 Hz to 50 kHz.

Gain can easily be adapted to the most suitable level for a particular use of the image produced on the output screen for a given incident radiation intensity (see FIG. 4).

The integration achieved through repeated storage and reading contributes to a better noise signal ratio.

It may be possible to reduce noise by working close to the saturation zone of curve $L=f(V)$ in FIG. 2.

The duration of the addressing time has to be limited, since the voltage induced in the cell by the electron beam, which increases on each cycle, could bring about such saturation.

Finally, the thin-layer structure of the electroluminescent cell, with the thicknesses stated above, permits high resolution of output images. These cells are commonly disc-shaped on their base, and 25 to 50 mm in diameter.

Figure 7:
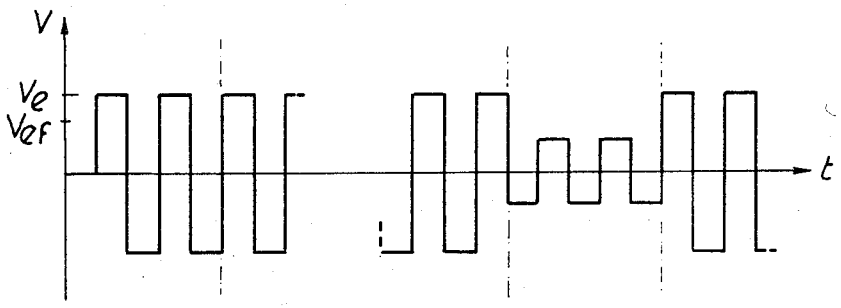

The image is erased simply by reducing the amplitude of the voltage to below $V_{ef}$. The right-hand part of FIG. 7 shows the levels corresponding to this phase of the cycle; the part between the two left-hand mixed broken lines corresponds to reading, which here immediately follows the incident ray pulse, as in the case illustrated in FIG. 5; the part to the right of the last mixed broken line corresponds to the addressing of a new image.

Figure 8:
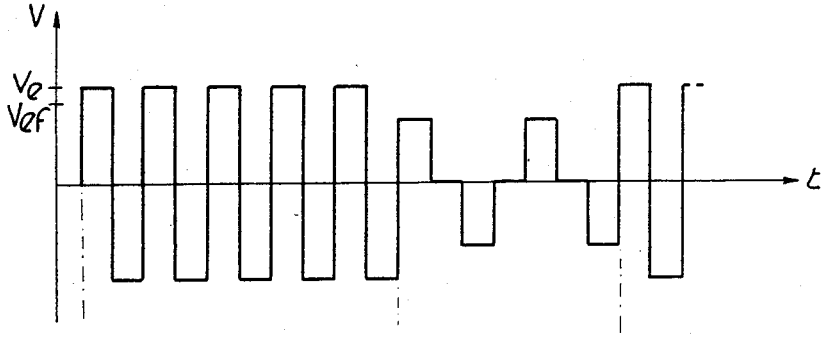

In another embodiment, illustrated in FIG. 8, direct X-rays are used. In this embodiment, real-time operation is employed, with no data storage. The image is presented throughout the addressing period, then erased, after which a second image is addressed and displayed, and so on.

In this case, each image cycle includes two steps. The first step includes:

addressing by electron bombardment and display of the image in real time; throughout the addressing interval, luminance increases at each level of voltage supplied, since internal polarization of the cell rises throughout this interval, during which the cell is supplied with the maintenance voltage $V_e$ (the part of FIG. 8 between the first two mixed broken lines).

The second step includes:

erasure of the image, which can be done by electron bombardment; it simply includes reducing the amplitude of the applied voltage below $V_{ef}$, and possibly, this time, separating the change in the levels of the voltage either by dead time or by zero voltage amplitude times (the part of the figure between the last two mixed broken lines).

A cycle may last 20 ms, making the image display suitable for photographing with a still or television camera (26 and 28 in FIG. 4).

The frequency of the maintenance voltage, its amplitude, the length of the addressing time, the image frequency (or duration of a complete cycle), the X-ray dose and the addressing electron acceleration voltage are parameters which enable the image display to be adapted to its intended usage.

Mixed functions, combining these two modes, can also be obtained, permitting:

real-time analysis, with repetition by a TV camera for evolving images, using the continuous process described above; or stoppage on a fixed picture, by simultaneous elimination of addressing, the X-rays, and the image cycle erasure phase, so that the last image is memorized and displayed during the time needed for observation, using the pulsed process described above.

What is claimed is:

1. A picture intensifier tube comprising a vacuum enclosure enclosing at opposite ends an input screen which is adapted to be irradiated with radiation corresponding to the image to be intensified and incorporates a photocathode for emitting electrons corresponding to the image, simultaneously over its entire emitting surface, and an output screen separated by space from the input screen and positioned to be bombarded by the emitted electrons for providing the intensified image, characterized in that the output screen comprises an electroluminescent cell which has a pair of opposed surfaces, is adapted for emitting visible light rays when an alternating voltage of amplitude larger than that of a characteristic threshold voltage is applied between its surfaces, has hysteresis such that so long as the applied voltage is maintained above an erasure voltage light emission is maintained even though the applied voltage drops below the characteristic threshold voltage, and has the property that electron bombardment effectively augments the applied voltage so that even an applied voltage lower than the characteristic threshold voltage permits emission of visible light.

2. A tube in accordance with claim 1 which further includes means between the input and output screens for accelerating and directing the electrons emitted from the input screen towards the output screen.

* * * * *